US005868054A

United States Patent [19]

Chubb et al.

[11] Patent Number: 5,868,054

[45] Date of Patent: Feb. 9, 1999

[54] PORTABLE SAW TABLE

[75] Inventors: Arthur B. Chubb, Romulus; Douglas G. Break, Livonia; Douglas J. Chubb, Carleton; James E. Suyak, Lincoln Park, all of Mich.

[73] Assignee: Tapco International Corporation, Plymouth, Mich.

[21] Appl. No.: 926,855

[22] Filed: Sep. 10, 1997

Related U.S. Application Data

[63] Continuation of Ser. No. 415,558, Apr. 3, 1995, abandoned, which is a continuation-in-part of Ser. No. 310,669, Sep. 22, 1994, abandoned, which is a continuation-in-part of Ser. No. 840,319, Feb. 24, 1992, abandoned.

[51] Int. Cl.[6] ..... B27B 5/20

[52] U.S. Cl. ..... 83/522.18; 83/471.3; 83/581; 83/468.3; 144/286.5; 144/287; 144/379

[58] Field of Search ..... 83/471.3, 486.1, 83/581, 574, 468.3, 490, 471, 471.2, 522.18, 522.15, 522.16, 522.17, 522.19, 468; 144/286.1, 286.5, 287, 379

[56] References Cited

U.S. PATENT DOCUMENTS

| | | | |
|---|---|---|---|
| 1,758,623 | 5/1930 | Roth et al. | 83/471.3 X |
| 2,633,162 | 3/1953 | Neuenschwander | 83/471.3 X |
| 2,655,955 | 10/1953 | Dziengiel | 83/486.1 X |
| 2,739,624 | 3/1956 | Haddock | 83/486.1 X |
| 2,770,265 | 11/1956 | Pollock | 83/468.3 X |
| 2,818,892 | 1/1958 | Price | 83/471.3 |
| 2,833,609 | 5/1958 | Lawless . | |
| 3,130,758 | 4/1964 | McKinley . | |
| 3,384,135 | 5/1968 | Frydenlund | 83/471.3 X |
| 3,574,315 | 4/1971 | Boultinghouse . | |
| 3,789,712 | 2/1974 | Enders | 83/486.1 X |
| 3,821,918 | 7/1974 | Nichaus . | |
| 3,872,755 | 3/1975 | Marsh . | |
| 3,955,456 | 5/1976 | Van Cleave . | |
| 3,964,361 | 6/1976 | Allaire . | |
| 4,079,648 | 3/1978 | Chappell . | |
| 4,135,419 | 1/1979 | Chapin . | |
| 4,155,383 | 5/1979 | Welliver . | |
| 4,181,057 | 1/1980 | Bassett . | |
| 4,197,775 | 4/1980 | Handler . | |
| 4,448,102 | 5/1984 | Thornton | 83/574 X |
| 4,452,117 | 6/1984 | Brickner . | |
| 4,516,453 | 5/1985 | Parham, Jr. . | |
| 4,545,274 | 10/1985 | Germond | 83/486.1 X |
| 4,561,336 | 12/1985 | Davis . | |
| 4,890,657 | 1/1990 | Shellhouse . | |
| 4,995,288 | 2/1991 | DellaPolla . | |
| 5,080,152 | 1/1992 | Collins . | |
| 5,421,231 | 6/1995 | Break et al. | 83/471.3 |
| 5,473,968 | 12/1995 | Break et al. | 83/471.3 |

*Primary Examiner*—Rinaldi I. Rada
*Assistant Examiner*—Boyer Ashley
*Attorney, Agent, or Firm*—Howard & Howard

[57] ABSTRACT

A portable saw table for a portable saw or router comprising a table base for supporting a workpiece, and a slide track support pivoted about a pivot axis to the table base. A slide is movable with respect to the support and slide tracks are mounted on the slide. A protractor is movable with the support and has indicia about the periphery thereof. An indicator on the table base is associated with the indicia of the protractor. The pivot axis and the protractor have common axis. A lock lever is pivoted on the protractor and a threaded shaft extends through the support and is threaded into the lock member for causing the lock lever to frictionally engage the table base and lock the support and slide in angularly adjusted position relative to the table base and longitudinally adjusted position relative to the support.

15 Claims, 18 Drawing Sheets

| LETTER | RISE | PITCH | RAFTER CUT | GABLE CUT |
|---|---|---|---|---|
| A. | 11/2–12 | 1/16 | 7° 7'30" | — |
| B. | 3–12 | 1/8 | 14° 2' | — |
| C. | 4–12 | 1/6 | 18° 26' | 71° 34' |
| D. | 6–12 | 1/4 | 26° 34' | 63° 26' |
| E. | 8–12 | 1/3 | 33° 41' | 56° 19' |
| F. | 12–12 | 1/2 | 45° | 45° |

PORTABLE SAW TABLE

This application is a Continuation of Ser. No. 08/415,558 filed Apr. 3, 1995 now abn, which is a continuation-in-part of Ser. No. 08/310,669 filed Sep. 22, 1994, now abn, which is a continuation-in-part of Ser. No. 07/840,319 filed Feb. 24, 1992 now abn.

BACKGROUND AND SUMMARY OF THE INVENTION

This invention relates to portable saw tables for supporting a portable saw or portable router in a manner that movement of the portable saw will cut workpieces at varying angles. Typical portable saw are shown in the aforementioned patent applications.

Among the objectives of the present invention are to provide a portable saw table which is light in weight; which is easily manipulated; which provides for movement of a saw track with respect to the workpiece supporting table; and which facilitates both convenient usage and collapsibility for transport and storage; and which can be readily collapsed for transport and storage.

In accordance with the invention, the portable saw table comprises a table base for supporting a workpiece, a slide track support pivoted about a pivot axis to the table base and a slide movable longitudinally with respect to the support. The slide track is mounted on the support for supporting a portable saw or router for movement along the track. A protractor is fixed to the support and has indicia about the periphery thereof and an indicator is mounted on the table base and associated with the indicia of the protractor.

DETAILED DESCRIPTION OF THE INVENTION

Figure 1:
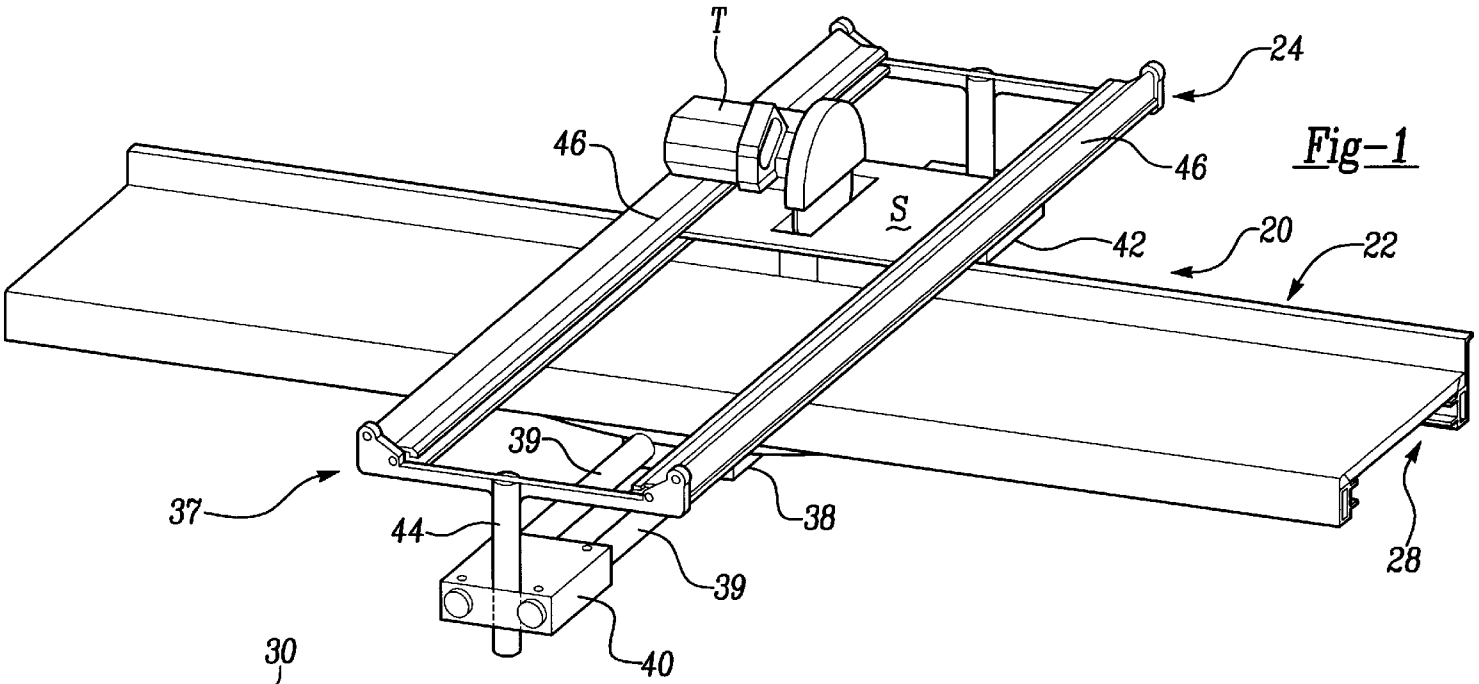
FIG. 1 is a perspective view of a portable saw table embodying the invention.
Figure 2:
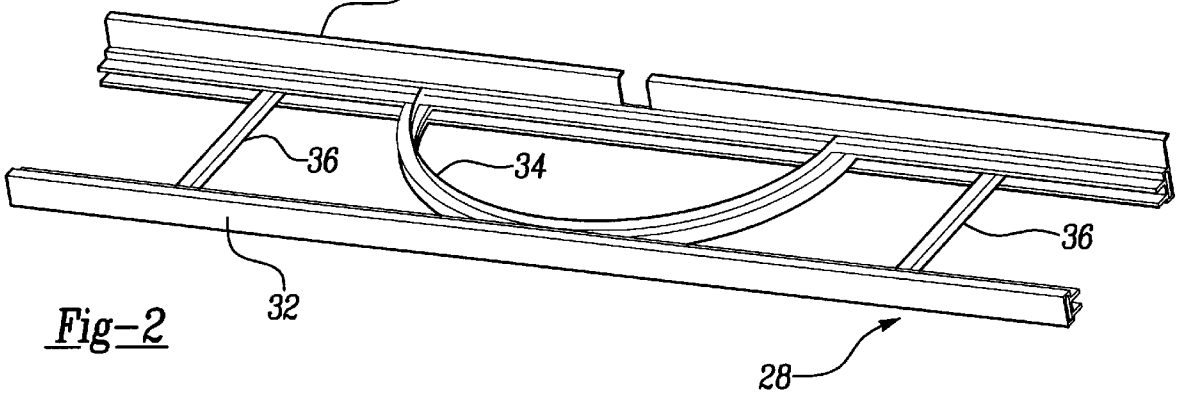
FIG. 2 is a perspective view of the table base frame.
Figure 3:
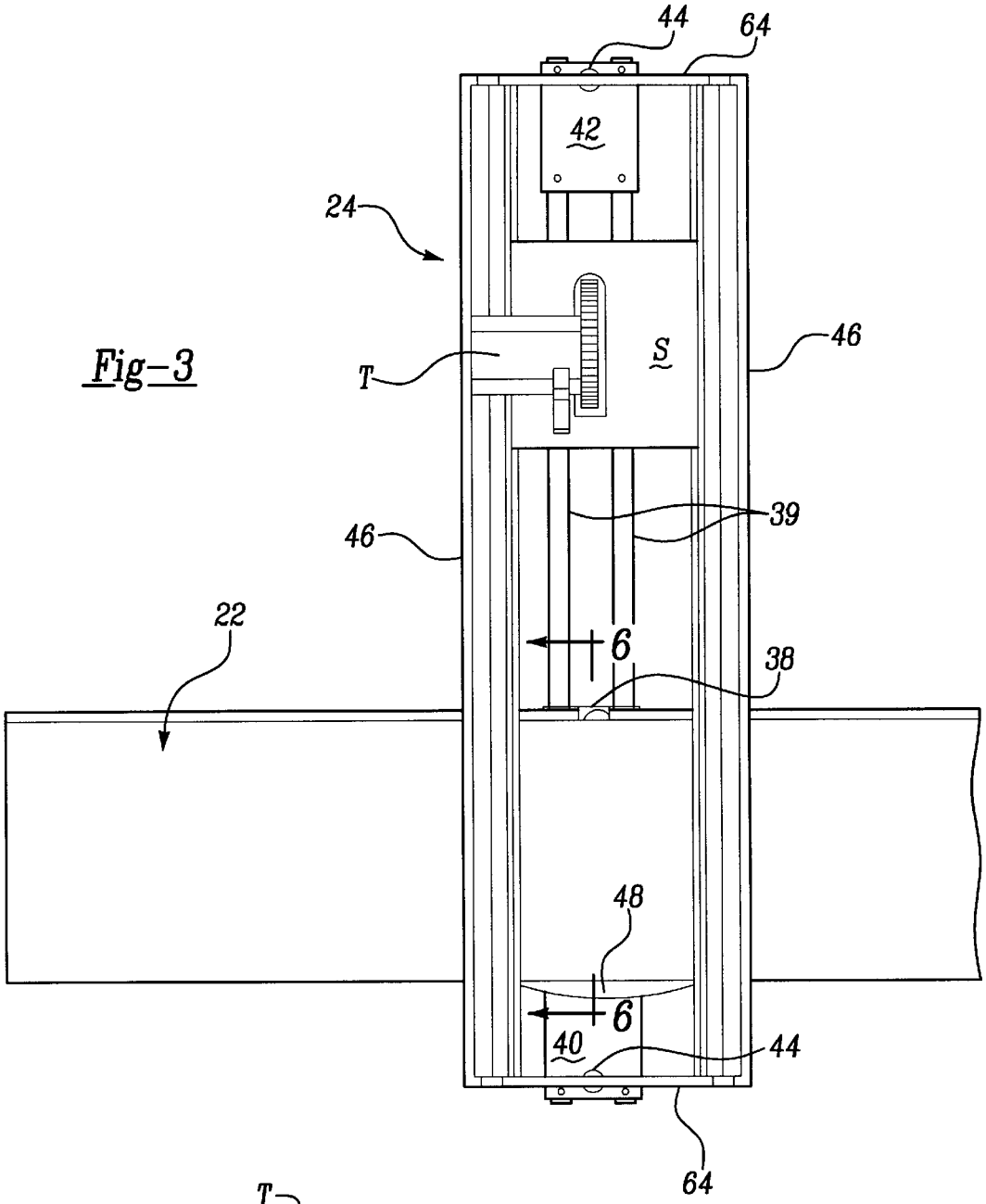
FIG. 3 is a plan view of the portable saw table.
Figure 4:
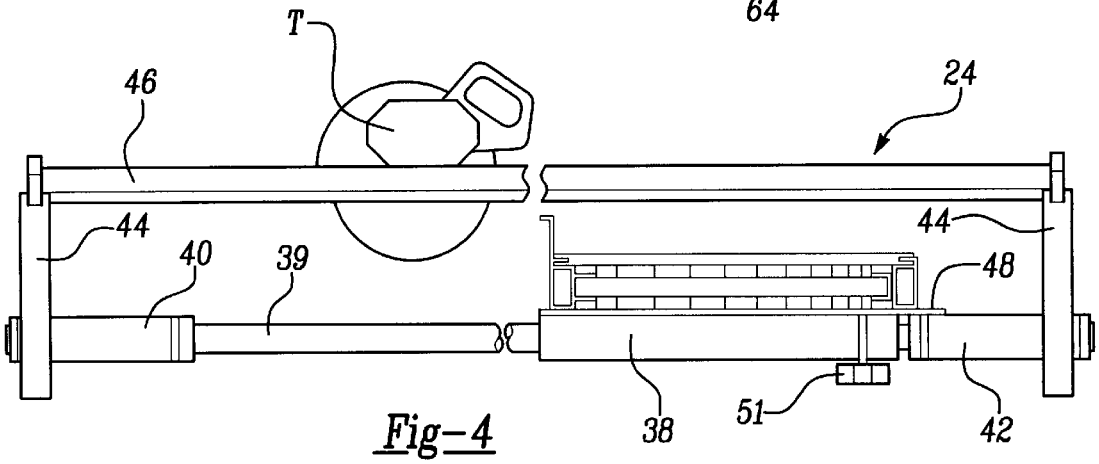
FIG. 4 is a side view of the portable saw table taken from the left in FIG. 1.
Figure 5:
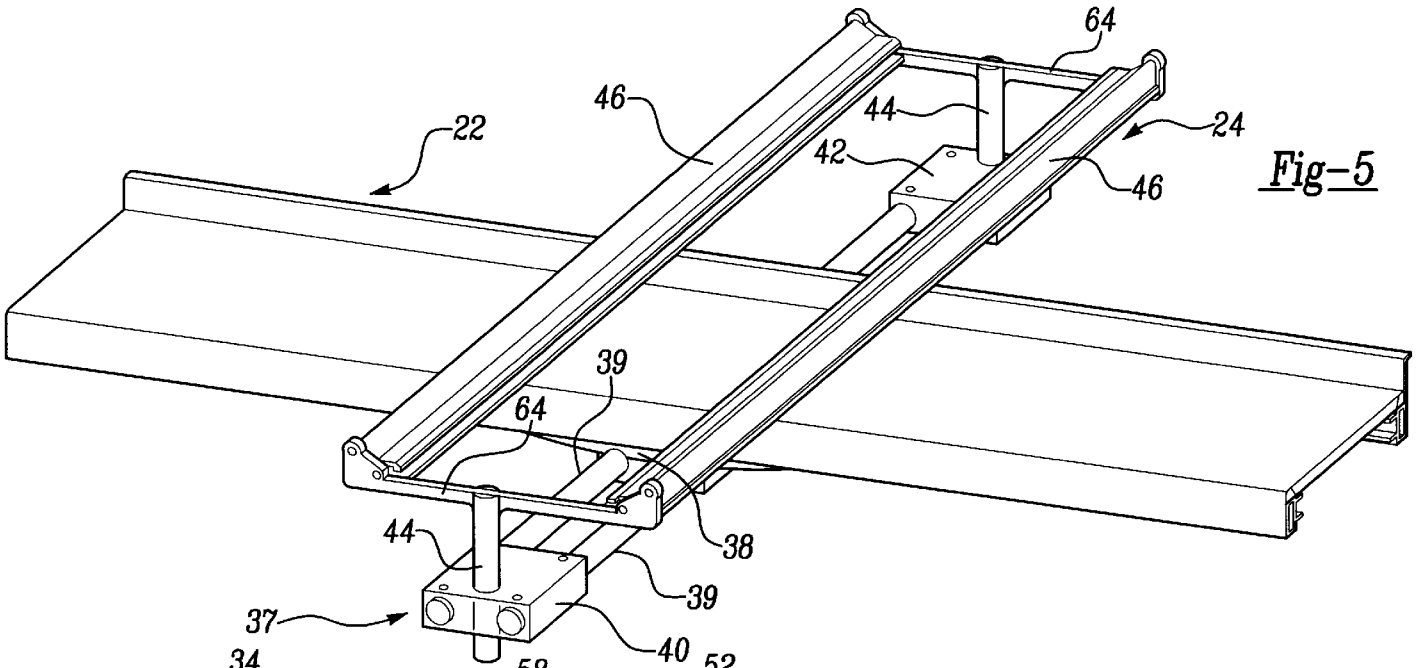
FIG. 5 is a perspective view of the portable saw table with the portable saw and saw plate removed.

Referring to FIG. 1, the portable saw table 20 embodying the invention comprises a table base 22 and a slide track assembly 24 which is pivoted to the table base 22 about a vertical axis and is slideable in a direction transversely of the vertical axis. The table base 22 includes a table frame 28 comprising a rear extruded rail 30 and a front extruded rail 32 joined by an arcuate extrusion 34 welded between the rails and by transverse rails 36 (FIG. 2).

The slide track assembly 24 comprises a support 38 that is pivoted to the frame 28, as presently described. The support 38 slideably supports a slide 37, herein shown as slide members 39 in the form of tubes which are joined together at opposite ends by slide end members 40, 42 fixed to the tubes 39. Posts 44 on the members 40, 42 support spaced tracks 46 above the workpiece for receiving the portable saw or router T and its associated slide or supporting plate S (FIGS. 4, 5, 7–10). The manner of supporting the slide in the tracks is such as shown in the aforementioned patent applications, incorporated herein by reference.

Figure 6:
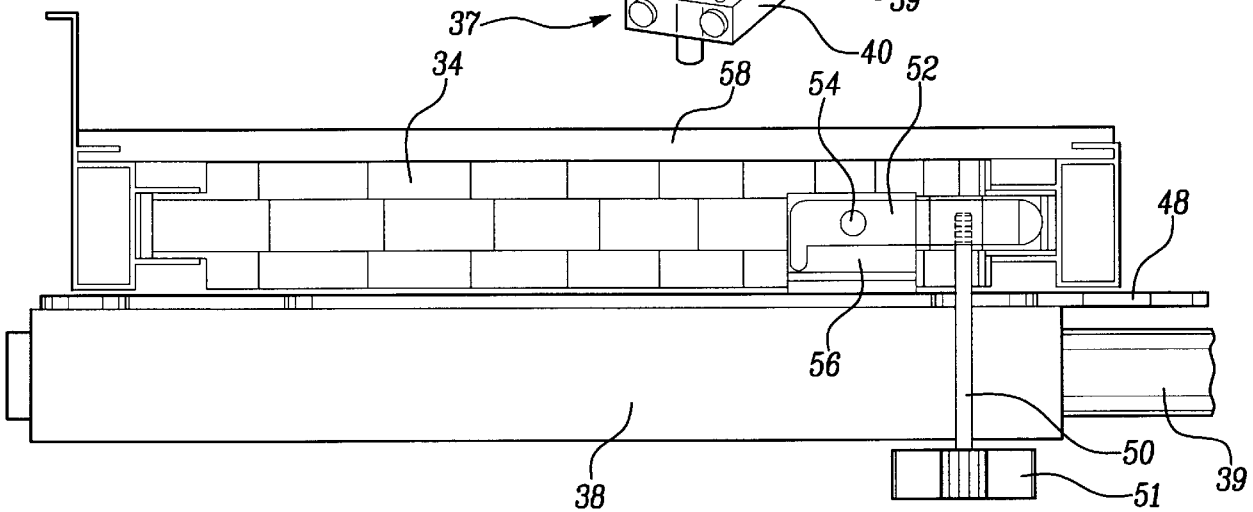
FIG. 6 is a sectional view taken along the line 6—6 in FIG. 3.
Figure 7:
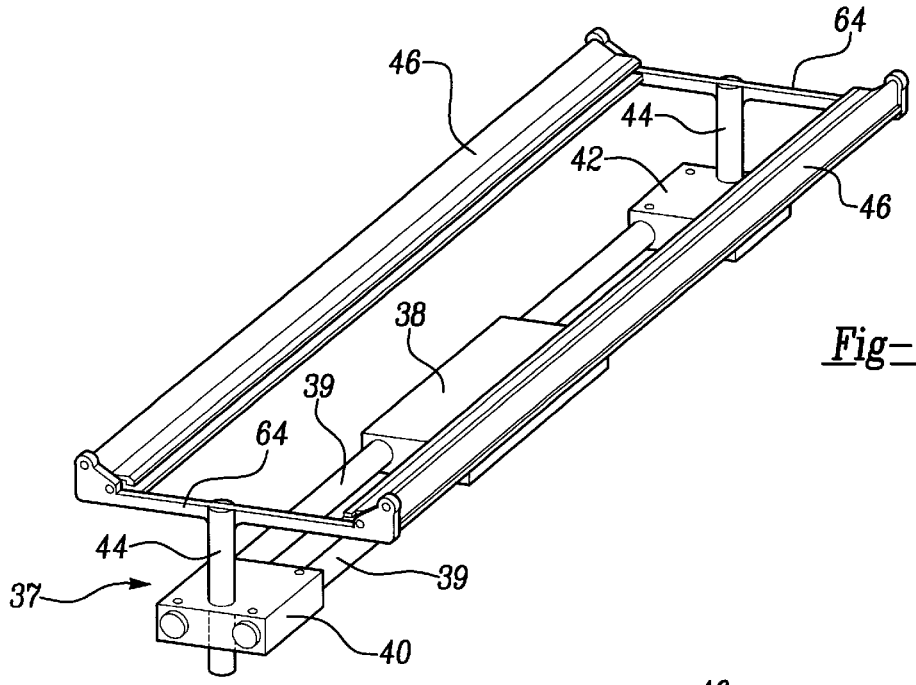
FIG. 7 is a perspective view of the slide assembly.
Figure 8:
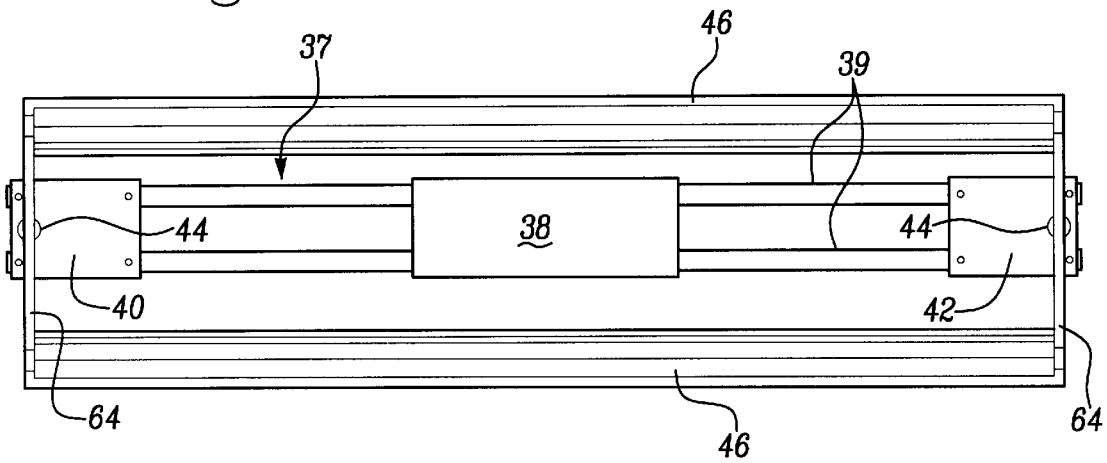
FIG. 8 is a plan view of the slide assembly.
Figure 9:
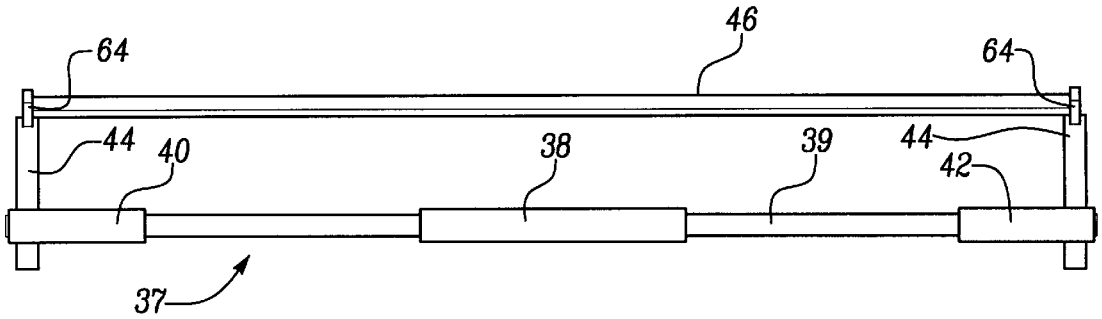
FIG. 9 is a side elevational view of the slide assembly.
Figure 12:
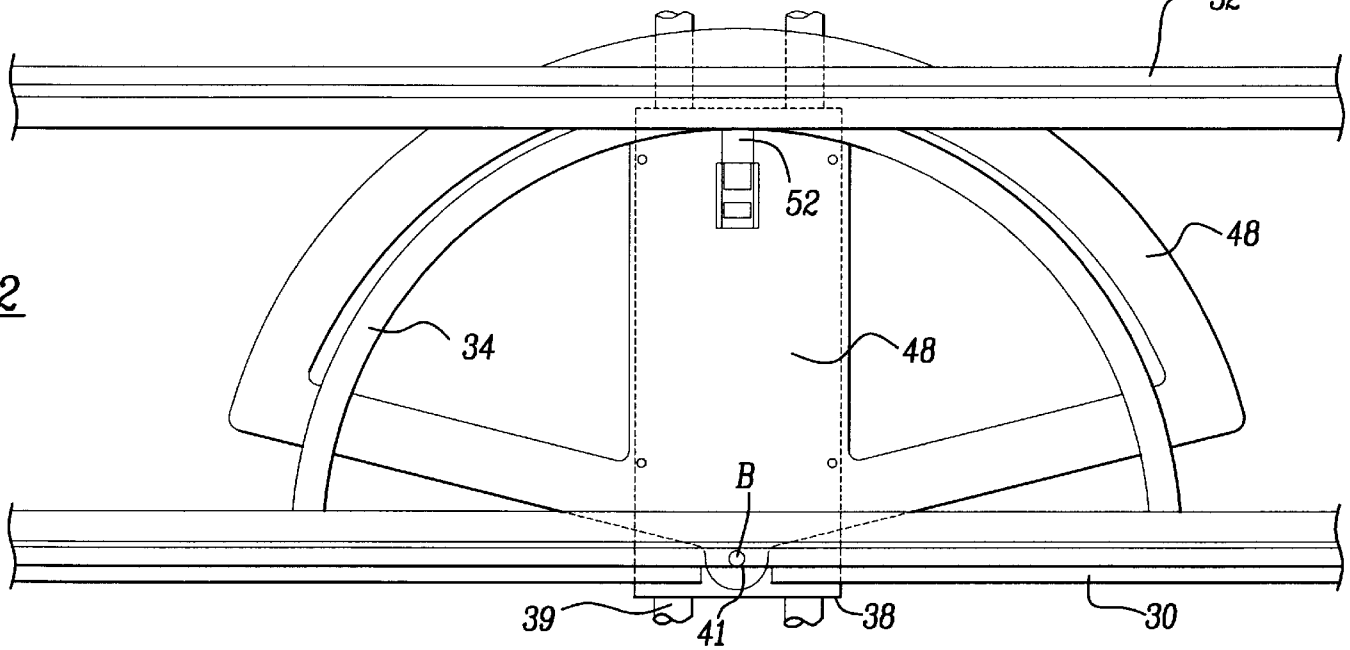
FIG. 12 is a plan view of a portion of the saw table shown in FIG. 11 with the workpiece support table removed.

Referring to FIG. 6, a protractor 48 is fixed on the slide support 38 and has an axis corresponding to the pivot axis of the support 38 on the underside of the table base. A pivot bolt and nut B extend through the table base 22, protractor 48 and support 38 at the pivot axis 41 (FIG. 12). In order to lock the support 38 and associated protractor 48 in locked position relative to the table base 24, a threaded shaft 50 operated by a knob 51 is threaded into a pivot lever 52 pivoted about an axis 54 on a bracket 56 mounted on the protractor. A plastic work supporting plate 58 is slideably mounted on the work table base as more clearly shown in the aforementioned patent applications, incorporated herein by reference. Rotating the knob 51 forces the lever 52 into frictional contact with the arcuate portion of the frame and locks the slide support 38 angularly and also locks the support longitudinally of the support 38 (FIGS. 6 and 12).

The slide track assembly 24 eliminates the need for the pivoting support tube used in prior art portable saw tables. The slide 37 is mounted for sliding movement on support 38 which allows track positioning to minimize cantilever imbalance. Also, it is no longer necessary to provide any more track length in front of the operator than is needed for the cut through the workpiece which translates into a key convenience because the operator only has to maneuver around the workpiece not the track assembly. The slide 37 and support 38 thus make the track assembly 24 in effect a telescoping track assembly.

Thus, for example, when an operator wishes to cut a workpiece at a right angle or at a small acute angle to the table base, the operator would push the slide assembly toward the work table such that very little of the length of the slide assembly would be facing the operator. This would permit the operator to readily move from one side of the slide assembly to the other. If the operator wishes to cut the workpiece at a large angle with respect to an original right angle position, the operator would slide the slide assembly toward the operator and move it to the desired angle. In any position of the slide assembly relative to the work table, the locking lever 52 engaging the C-shaped cross section arcuate portion 34 provides stability both when the knob is threaded to clamp the slide assembly in position or when the clamp is released during movement. This is achieved by the pivot bolt and the locking lever without the need for any further support, as might be needed in prior art portable saw tables. In order to hold the protractor in fixed position relative to the support 38, the shaft 50 is threaded through the support 38 into the protractor. The shaft 50 has a knob 51 for manual removal of the shaft in order to permit the protractor to also be rotated relative to the support 38 into the storage and transport positions shown in FIGS. 13–15.

Figure 10:
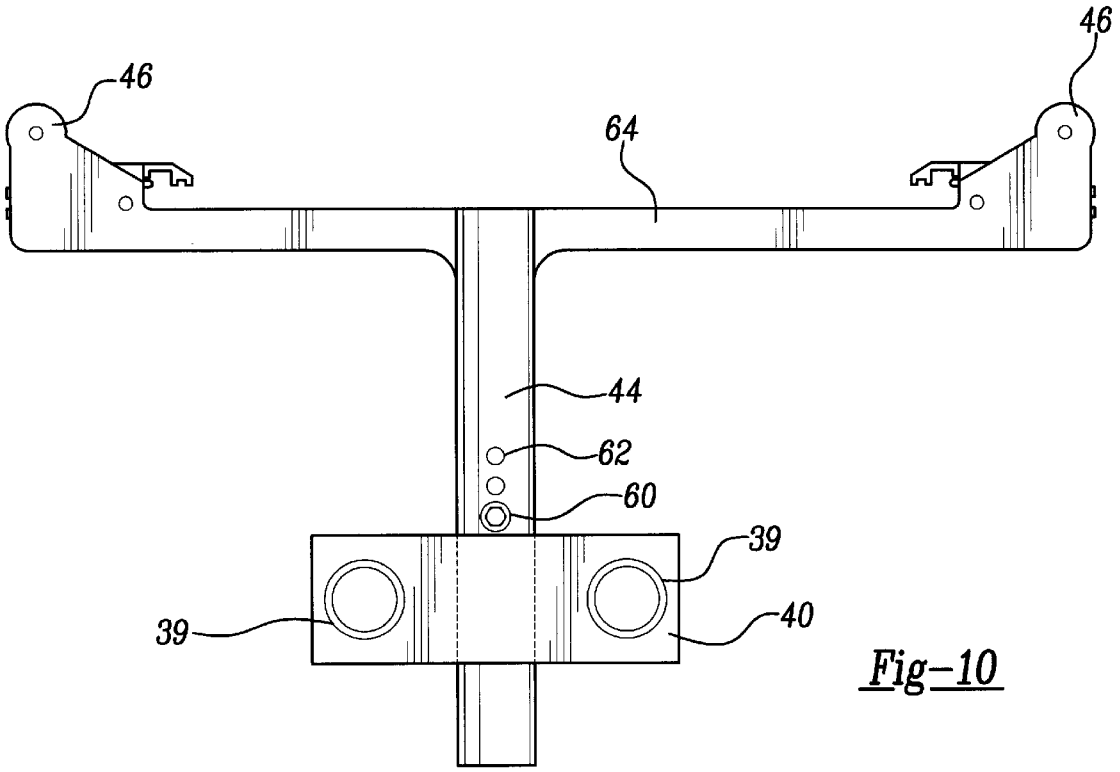
FIG. 10 is an end sectional view of the slide assembly.
Figure 11:
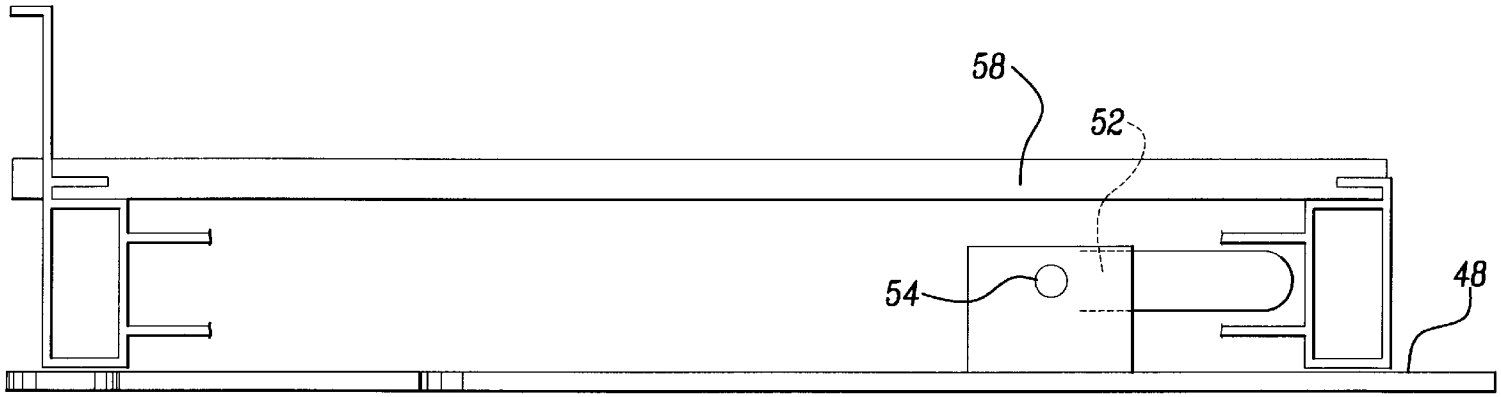
FIG. 11 is a view similar to FIG. 6, parts being broken away.

In accordance with another aspect of the invention, the saw tracks 46 are adjustable vertically by inserting a pin 60 in one of the respective spaced openings 62 in each post 44 such that the weight of the tracks causes engagement with the members 40, 42. As shown in FIG. 10, the tracks are mounted on transverse members 64 on the upper end of the posts 44.

Figure 13:
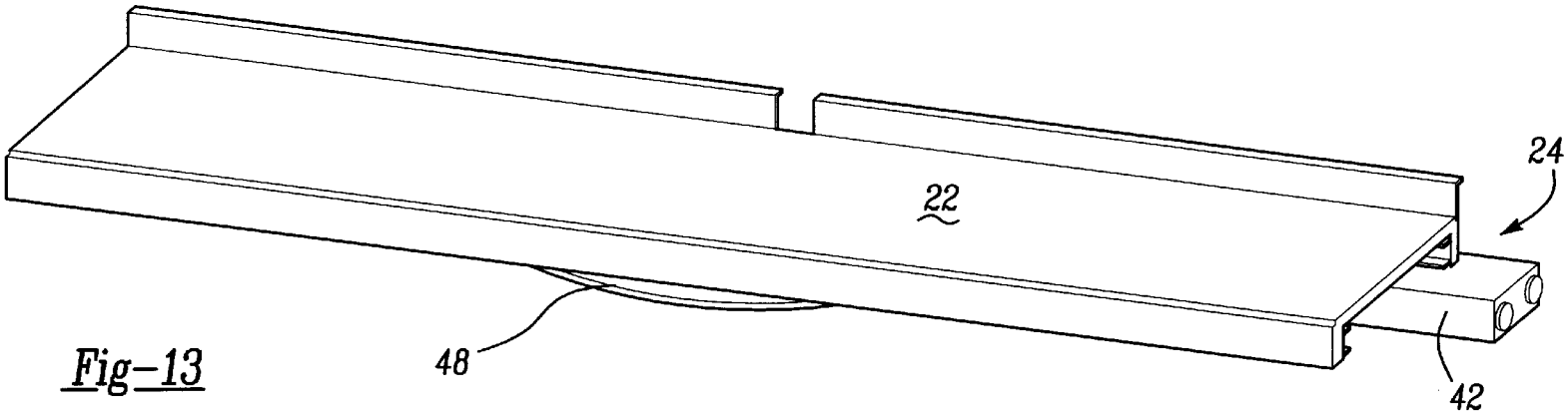
FIG. 13 is a perspective view of the portable saw table in storage position.
Figure 14:
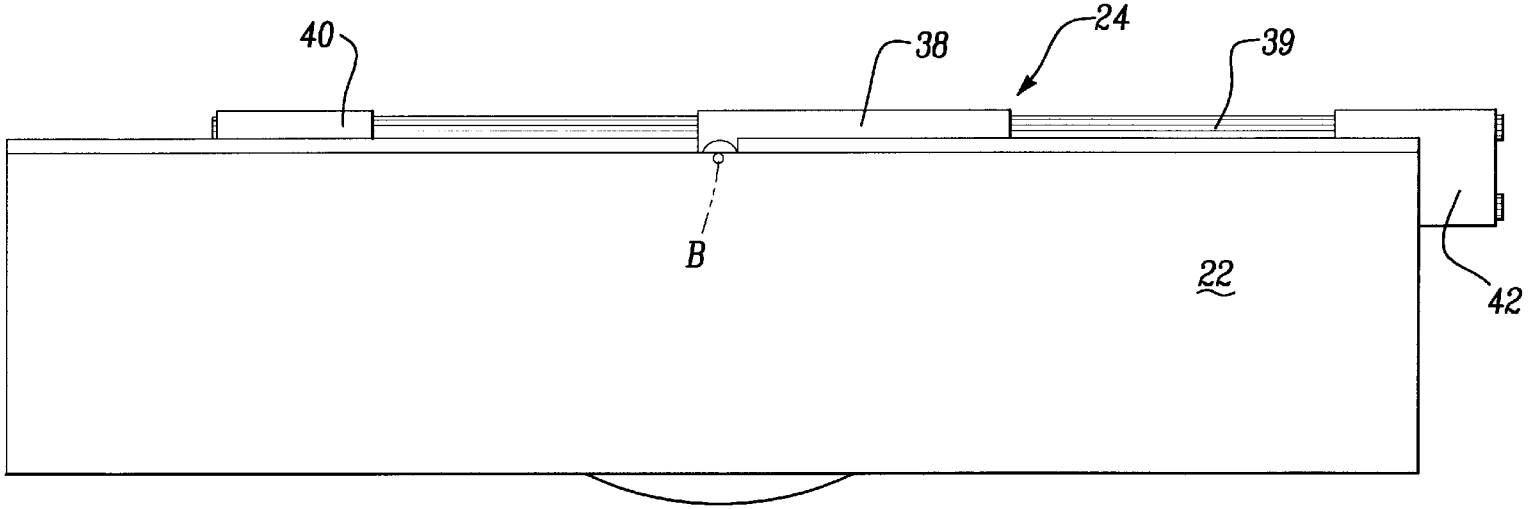
FIG. 14 is a top plan view of the portable saw table in storage position.
Figure 15:
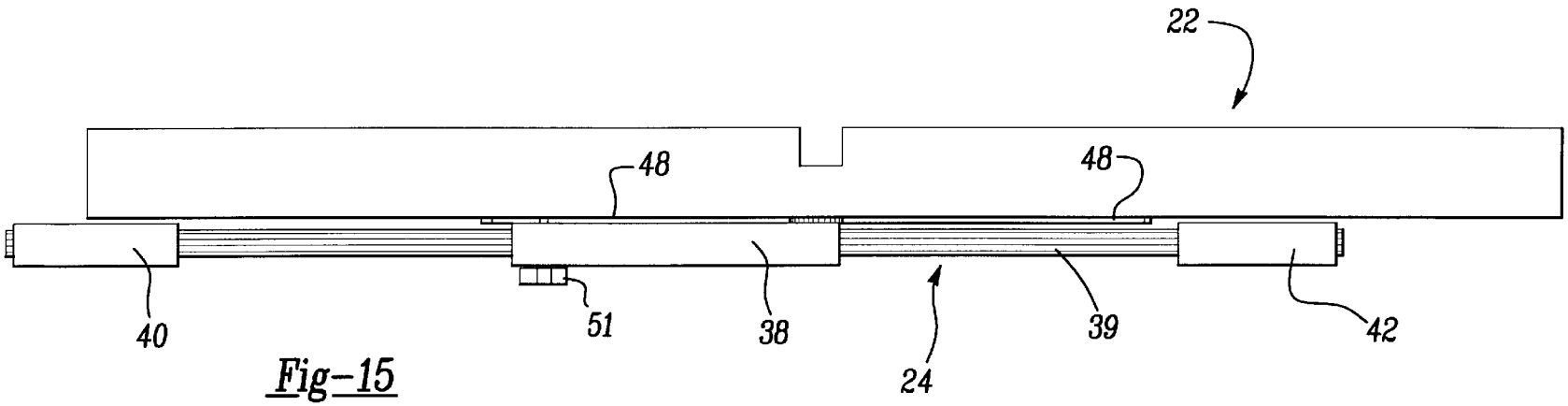
FIG. 15 is a side elevational view of the portable saw table in storage position.

The above described construction permits ready movement of the slide assembly relative to the table base 22 to bring the table base and slide assembly into alignment for transportation and storage as shown in FIGS. 13–15.

Figure 16:
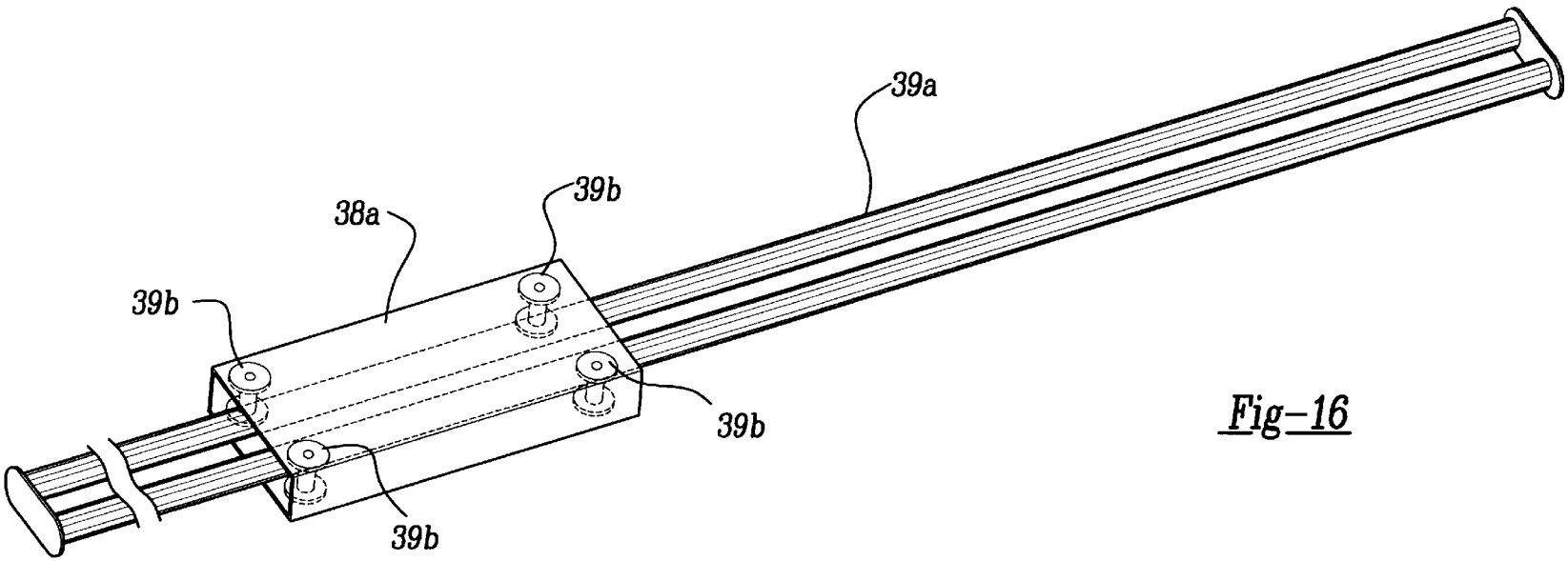
FIG. 16 is a perspective view of a modified form of slide for the slide table.

The slide that is associated with the support 38 can have other configurations preferably non-circular including a single slide such as elongated or oval slide 39*a* as shown in FIG. 16. Such an arrangement can include concave rollers 39*b* providing anti-friction support. In the previously described form, the anti-friction support in members 38 can be provided by blocks of plastic having openings for receiving the tubes 39.

A modified form of portable saw table is shown in FIGS. 17–30. For purposes of clarity, corresponding parts are shown with the suffix "a".

Figure 17:
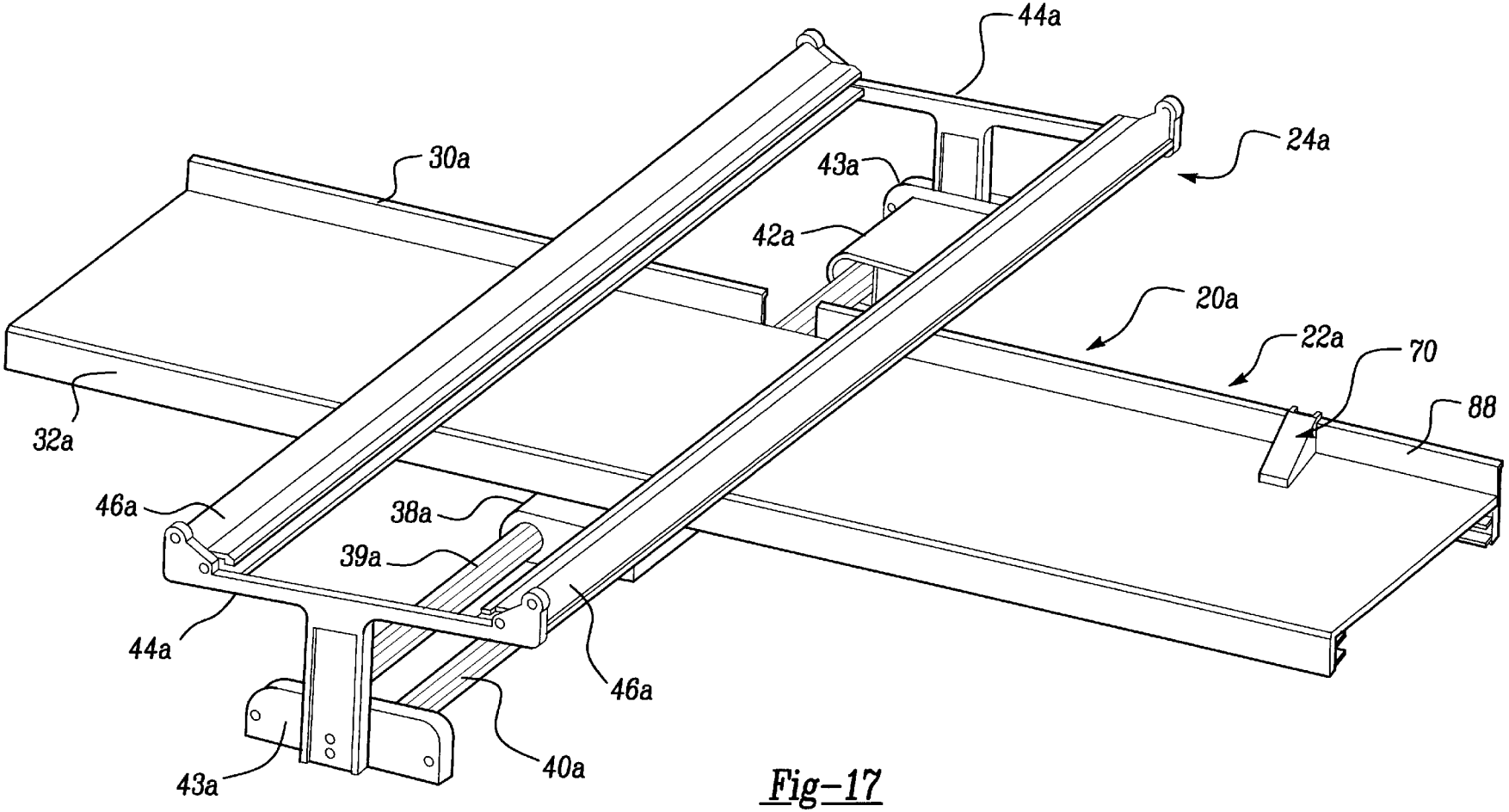
FIG. 17 is a perspective view of a modified form of portable saw table, parts being broken away.
Figure 24:
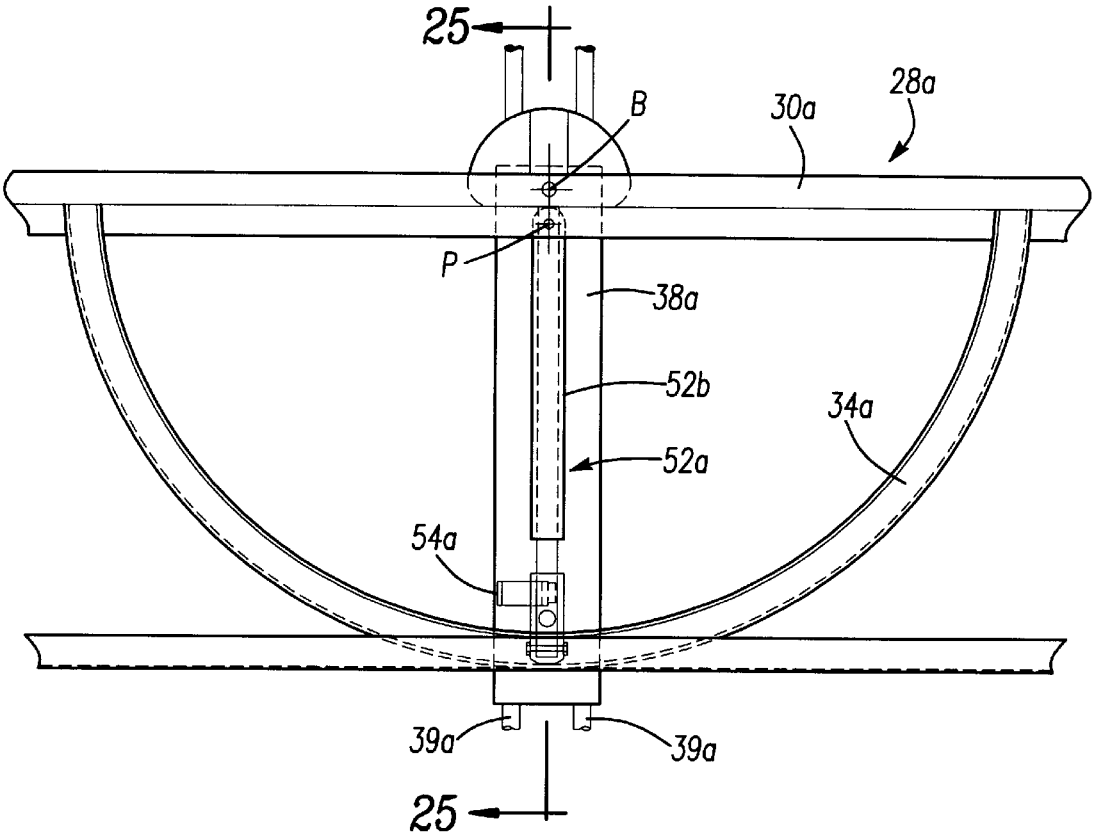
FIG. 24 is a fragmentary partly diagrammatic plan view of a portion of the portable saw table, parts being broken away.

Referring to FIG. 17, the portable saw table 20*a* embodying the invention comprises a table base 22*a* and a slide track assembly 24*a* which is pivoted to the table base 22*a* about a vertical axis and is slideable in a direction transversely of the vertical axis. The table base 22*a* includes a table frame 28*a* comprising a rear extruded rail 30*a* and a front extruded rail 32*a* joined by an arcuate extrusion 34*a* welded between the rails and by transverse rails (not shown) (FIG. 24).

The slide track assembly 24*a* comprises a support 38*a* that is pivoted to the frame 28*a,* as presently described. The support 38*a* slideably supports a slide, herein shown as slide members 39*a* in the form of tubes which are joined together at opposite ends by slide members 40*a,* 42*a* fixed to the tubes 39*a*. Vertical members 44*a* on the members 40*a,* 42*a* support spaced tracks 46*a* above the workpiece for receiving the portable saw or router T and its associated slide S, as in the previously described form. The manner of supporting the slide in the tracks is such as shown in the aforementioned patent applications, incorporated herein by reference.

Figure 22:
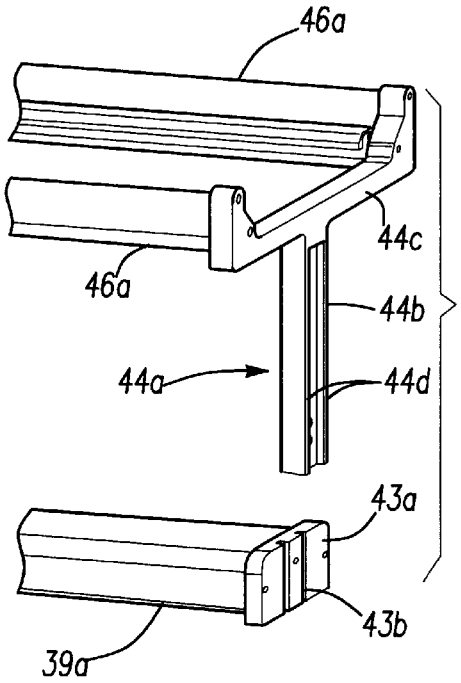
FIG. 22 is a fragmentary exploded perspective view of a portion of the slide assembly.
Figure 23:
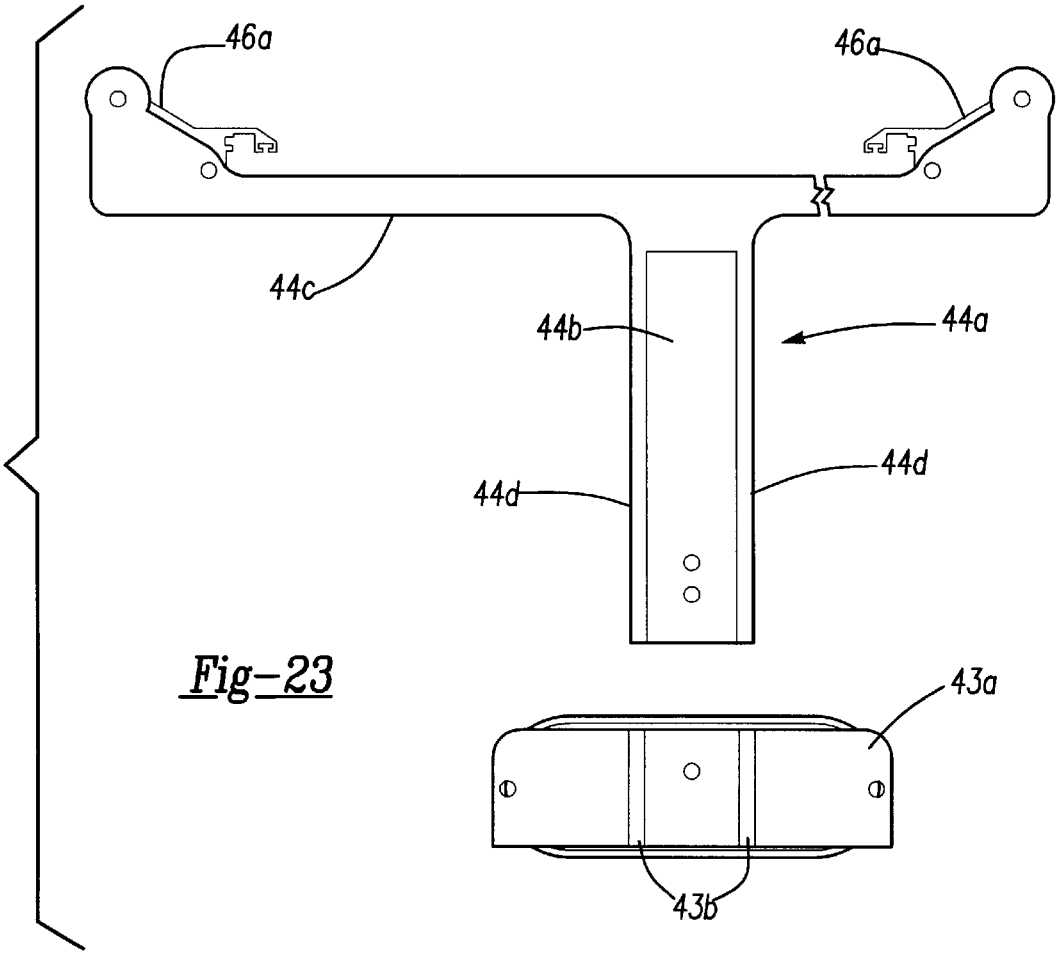
FIG. 23 is an exploded end view of the slide assembly shown in FIG. 22.

Brackets 43*a* close the ends of the members 40*a,* 42*a* and are fastened thereto by screws. In this form, the tracks are supported on end members 44*a* that include integral vertical portions that are vertically adjusted on brackets fixed to slide members 40*a,*42*a*. As shown in FIGS. 22 and 23, vertical members 44*a* are preferably cast aluminum members which have a vertical post portion 44*b* and a horizontal portion 44*c* which supports the tracks 46*a*. Vertical portion 44*b* has an I-beam cross section wherein the flanges 44*d* engage grooves 43*b* in the cast member 43*a*.

Figure 30:
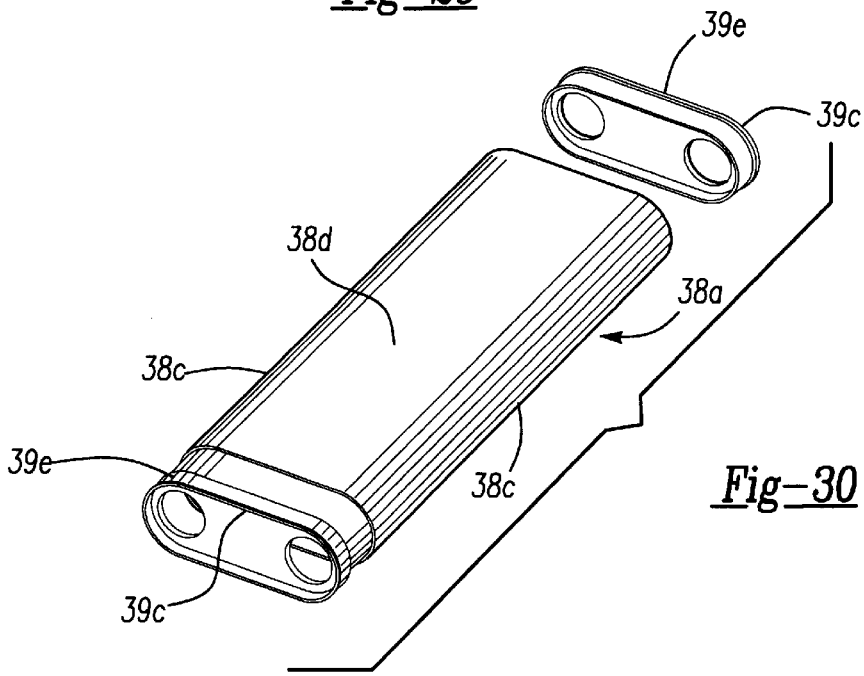
FIG. 30 is an exploded view of the center support of the slide assembly.
Figure 31:
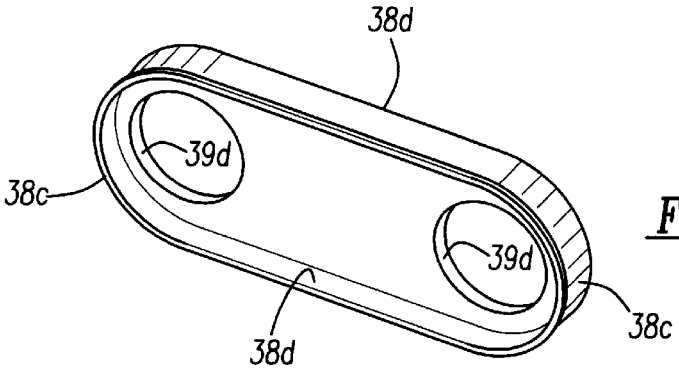
FIG. 31 is a perspective view of the end members provided on the center support.
Figure 33:
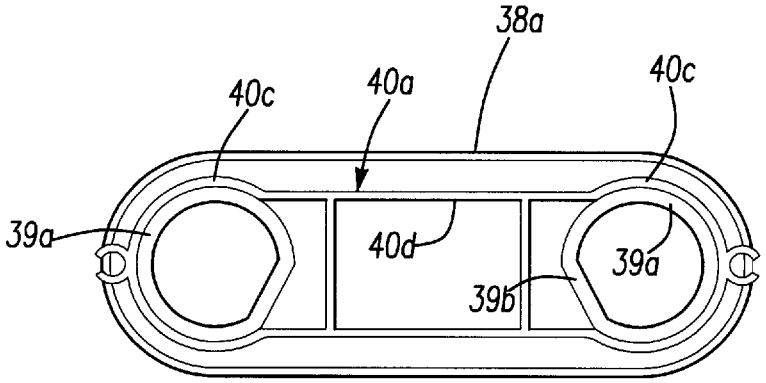
FIG. 33 is an end view of a slide support used in the portable saw table.

The support 38*a* and slide members 40*a,* 42*a* preferably comprise extruded and anodized aluminum members. The support 38*a* has a cross section comprising opposed semi-cylindrical portions 38*c* connected by spaced parallel walls 38*d* (FIGS. 30, 31). Plastic end members 39*c* made of a suitable resin such as acetal resin close the ends of support 38*a* and have openings 39*d* defining bearings for tubes 39*a* (FIGS. 30, 31). Each end member includes integral peripheral flanges 39*e* engaging the end of the tubular support 38*a*. Slide members 40*a,* 42*a* have a cross section as shown in FIG. 33 and include arcuate portions 40*c* connected by walls 40*d*. Arcuate portions 40*c* extend for more than 180° and receive tubes 39*a* which are cylindrical except for a longitudinal flat portion 39*b*.

Figure 18:
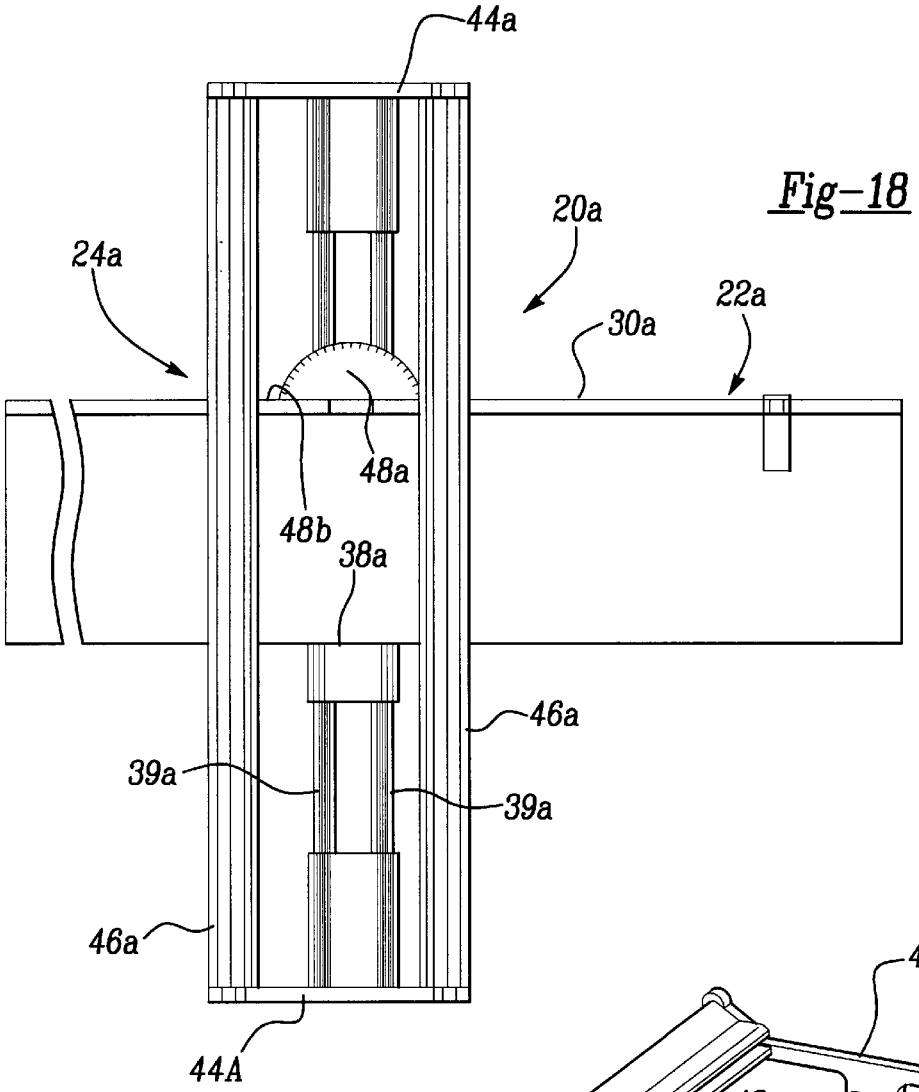
FIG. 18 is a plan view of the portable saw table shown in FIG. 17.
Figure 19:
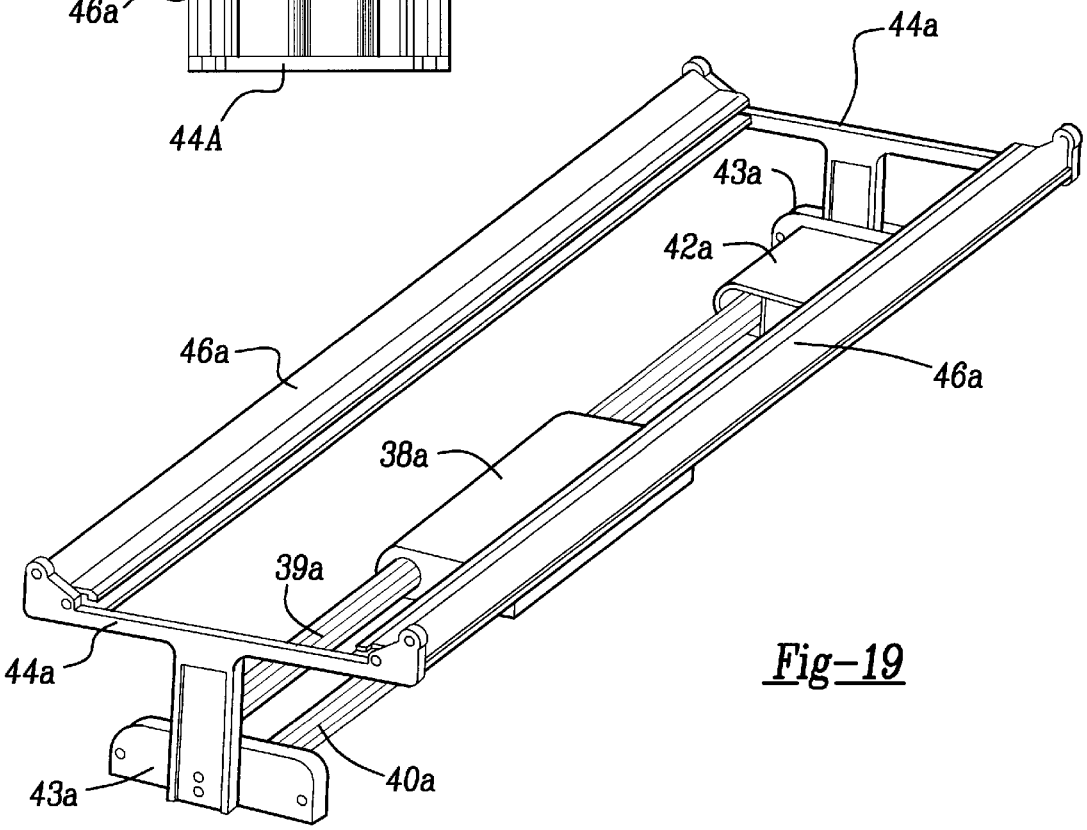
FIG. 19 is a perspective view of the slide assembly.
Figure 20:
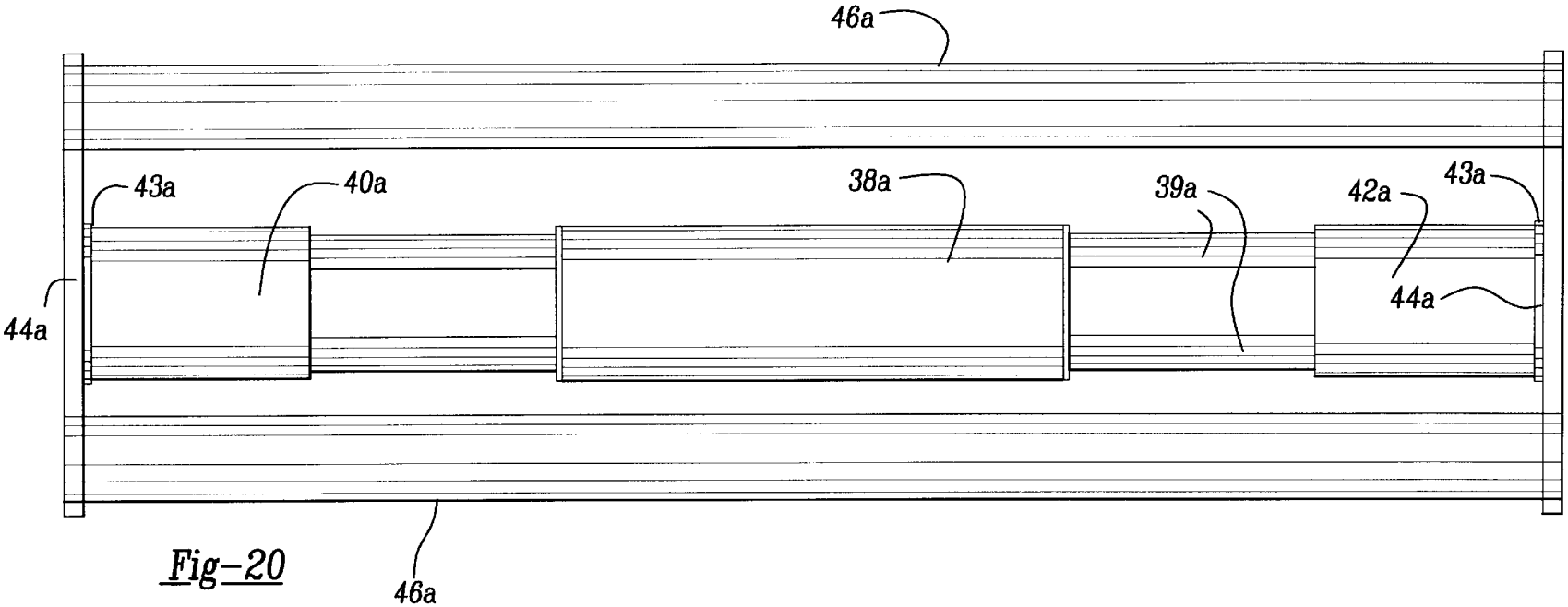
FIG. 20 is a plan view of the slide assembly shown in FIG. 19.
Figure 21:
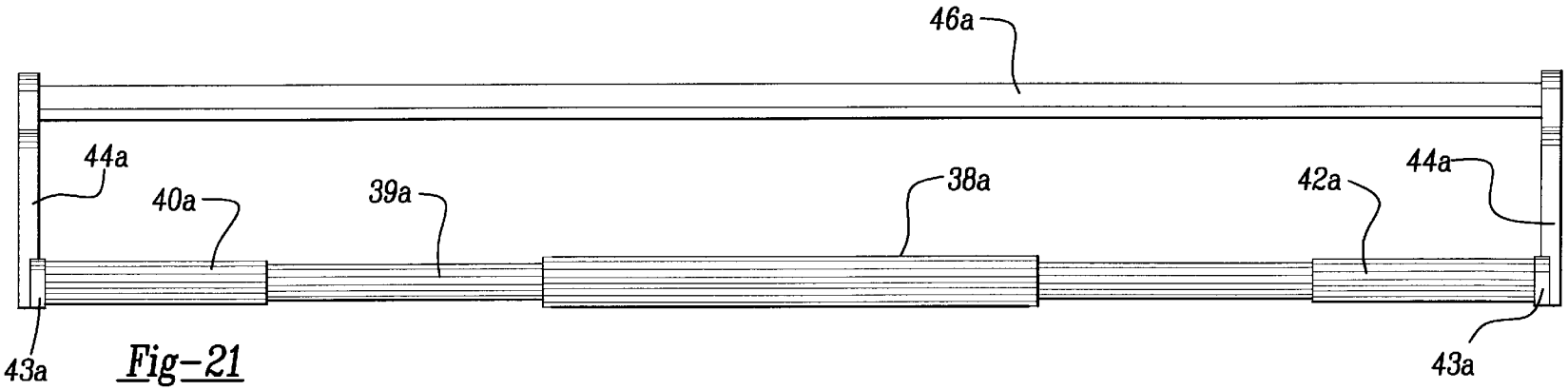
FIG. 21 is a side elevational view of the slide assembly.

Referring to FIGS. 18 and 24, a protractor 48*a* is fixed on the slide support 38*a* and has an axis corresponding to the pivot axis of the support 38*a* on the underside of the table base. As shown in FIGS. 18 and 24, protractor 48*a* is substantially smaller in diameter than that described in the previous form of portable saw table. Protractor 48*a* is positioned on support 38*a* and extends rearwardly of frame 28*a*. A pivot bolt and nut B extend through the table base 24*a,* protractor 48*a* and support 38*a* at the pivot axis. An indicator 48*b* is mounted on the table base and is preferably made of transparent plastic material such as polycarbonate resin.

Referring to FIGS. 24–27, the support 38*a,* protractor 48*a* and slide of the portable saw table are locked in position by a construction which includes a horizontal member 52*a* pivoted on the table base frame 28*a* at P and a threaded shaft 50*a* extends through the support 38*a* and into the horizontal member. The threaded shaft 50*a* includes a knob 50*b* on the lower end for grasping the shaft 50*a*. Preferably, the threaded shaft 50*a* is threaded to a bracket 54*a* fixed on horizontal member 53*a* by a pin. The lower end of the bracket includes a lip 54*b* that extends through a slot 55 in the upper wall of support 38*a* for providing a connection to the support 38*a* when the shaft 50*a* is loosened.

Where there is a difference between the pivot of the frame 28*a* and track assembly and the pivot of the horizontal member 52*a,* the horizontal member comprises two telescoping shaft portions 52*b,* 52*c* movable axially relative to one another and a spring 53 yieldingly urging the shaft portions apart. One shaft portion 52*a* is pivoted to the front rail of the table base by a pivot pin or screw. The other shaft portion 52*b* engages a wall of the arcuate portion 34*a* and preferably supports a plastic fitment 52*d* that extends beyond the end of shaft portion 52*c* and engages the wall of the arcuate portion 34*a.*

Figure 32:
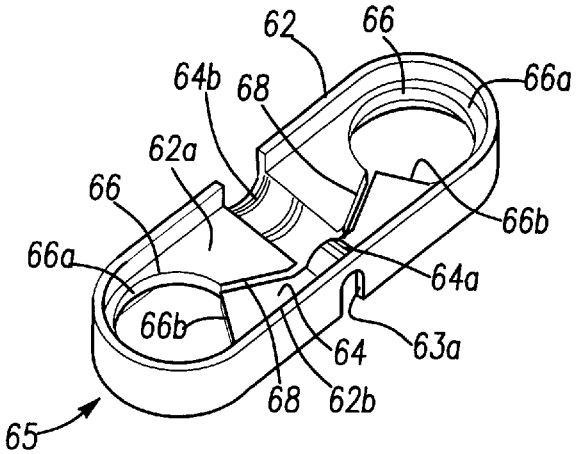
FIG. 32 is a perspective view of a bearing used in the portable saw table.

A plastic bearing member 65 made of suitable plastic such as acetal resin is provided within the support 38*a* and has the configuration shown in FIG. 32. Bearing 65 includes a peripheral wall 62 and a transverse wall 64. Transverse wall 64 has openings 66 having the same configuration as the cross section of the tubes for receiving the tubes 39*a.* This configuration includes a curved portion 66*a* and flat portions 66*b.* Wall 64 is split as at 68 to define wall portions 62*a,* 62*b,* the latter including flat portions 66*b* of the openings 66, such that when the threaded shaft 50*a* is threaded upwardly, the portions of the peripheral wall 62 between the tubes 39*a* are squeezed together causing the wall portions 64*a,* 64*b* of wall 64 to tighten against the tubes 39*a,* thereby not only locking the support 38*a* and protractor 48*a* in adjusted angular position but also locking the slide in its relation to support 38*a.* Wall 64 also includes opposed curved portions 64*b,* 64*c* for guiding shaft 50*a* through a slot 63*a* in the wall 62 upwardly into the bracket 54*a.* Knob 50*b* includes an axial portion 50*c* that extends through slot 63*a* when the shaft 50*a* is threaded into the bracket 54*a* thereby compressing the lower parts of peripheral wall 62 against the inside surface of tubular support 38*a.* A keeper such as a spring clip K is provided within the support 38*a* to prevent the threaded shaft 50*a* from dropping out of the saw table when the shaft is completely unthreaded from the bracket 54*a.*

Figure 34:
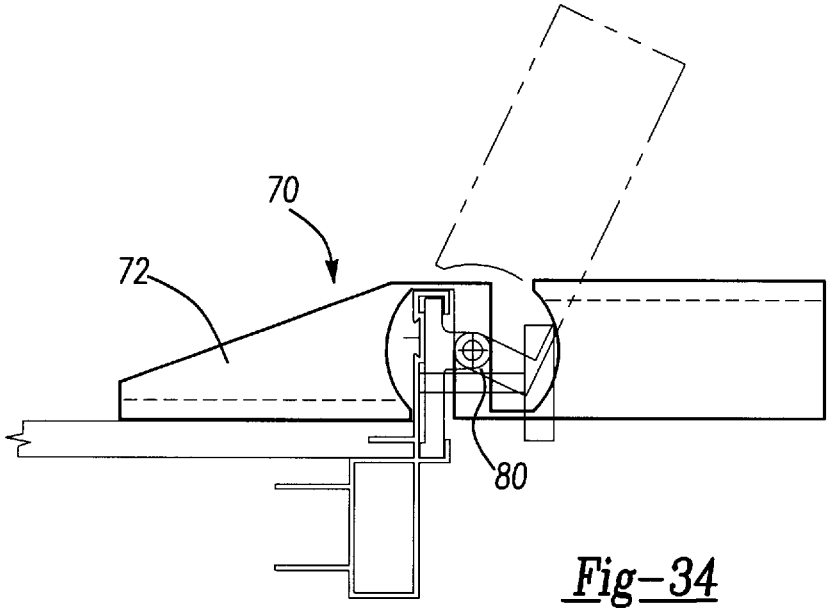
FIG. 34 is a fragmentary view of a workpiece stop assembly in position.
Figures 35, 37:
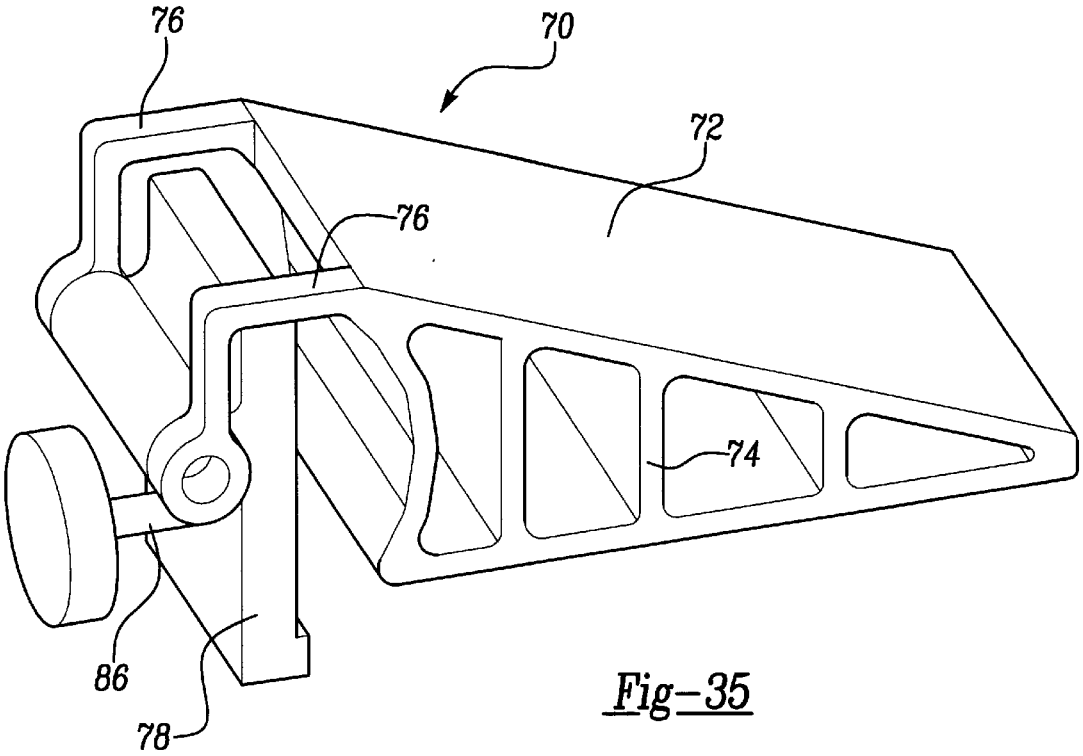
FIG. 35 is a perspective view of the workpiece stop assembly.
FIG. 37 is a plan view of a label used on the portable saw table.

Referring to FIGS. 34 and 35, in accordance with another aspect of the invention, a work stop member assembly 70 is slideably positioned on a rear wall of the rear rail 30*a.* The stop member assembly 70 comprises an extruded and anodized aluminum body 72 which includes a hollow portion having reinforcing walls 74 within the hollow portion. The body 72 further comprises integral hinge portions 76 which are machined on body 72 to form hinge legs. The legs are hinged to the plate 78 by a hinge pin 80.

The plate 78 is slideably received in the integral vertical portion on rear rail 30*a* between U-shaped flanges 82, 84. A knob shaft 86 is threaded through plate 80 and frictionally engages wall 88 (FIG. 17) on rear rail 30*a* to lock the stop assembly 70 in position on the portable saw table.

Figure 36:
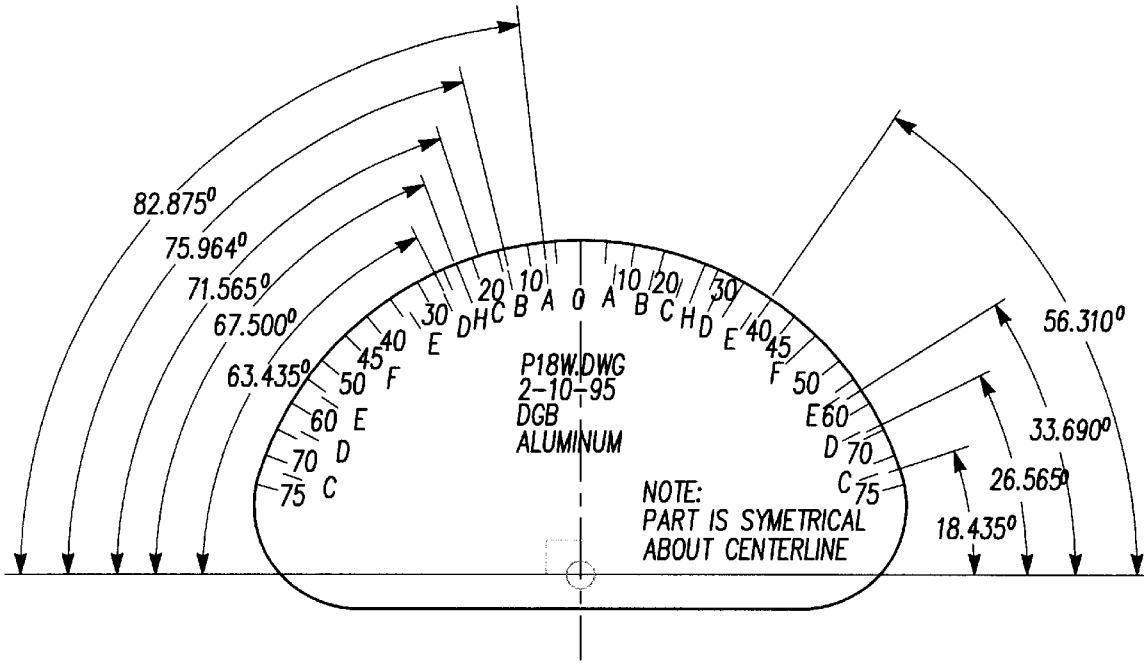
FIG. 36 is a plan view of a protractor used in the portable saw table.

Referring to FIGS. 36 and 37, the protractor preferably has two types of indicia, one in degrees and the other in letters designating use and pitch in accordance with the table shown in FIG. 37. A decal having the data in the table is applied at an appropriate area of the portable saw table, preferably on the forward slide members 40*a.*

Figure 28:
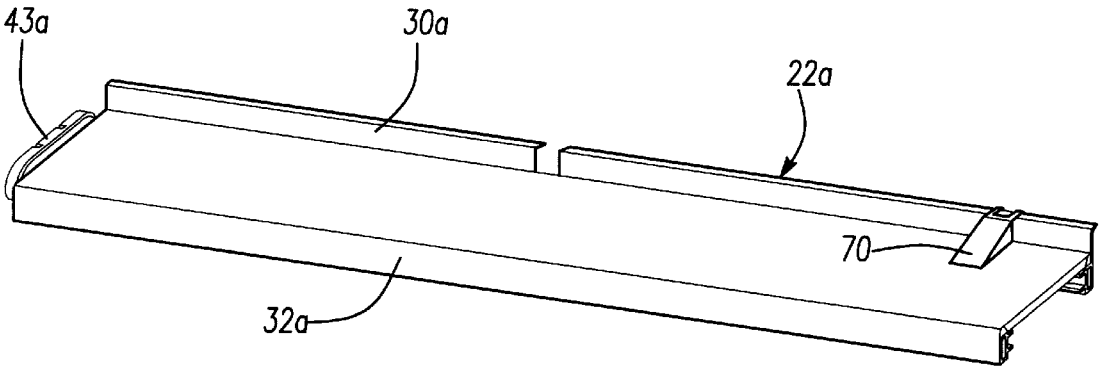
FIG. 28 is a perspective view of the portable saw table in stored position, parts being broken away.
Figure 25:
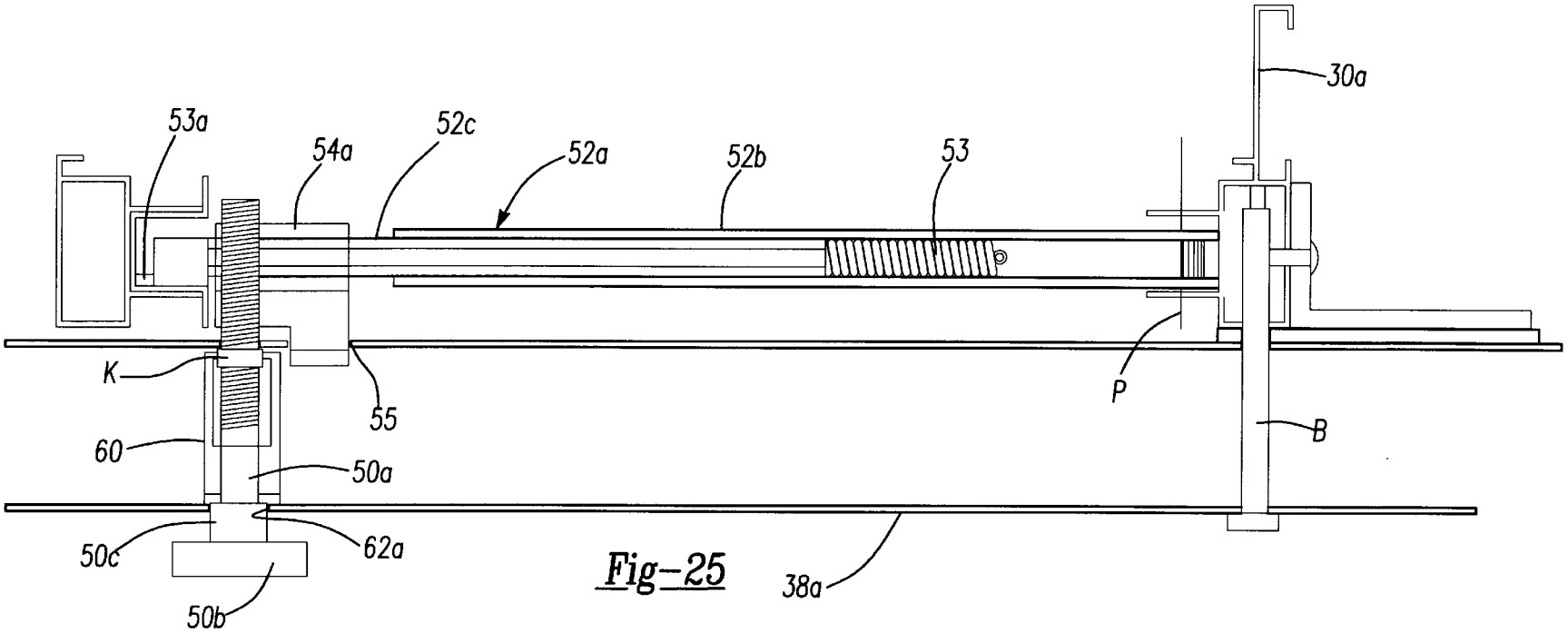
FIG. 25 is a fragmentary sectional view taken along the line 25—25 in FIG. 24.
Figure 27:
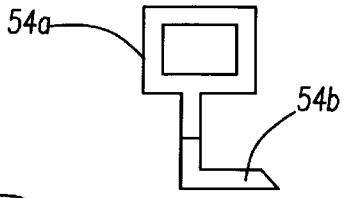
FIG. 27 is an end view of a part shown in FIG. 25.
Figure 26:
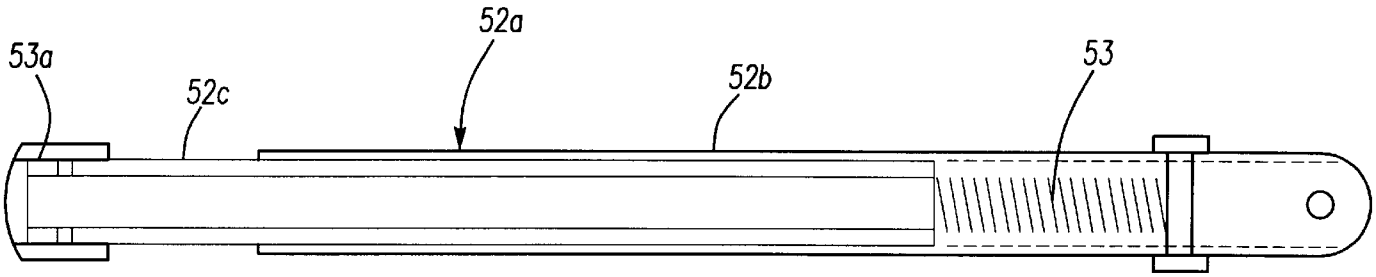
FIG. 26 is a plan view of a portion of the structure shown in FIGS. 24 and 25.
Figure 29:
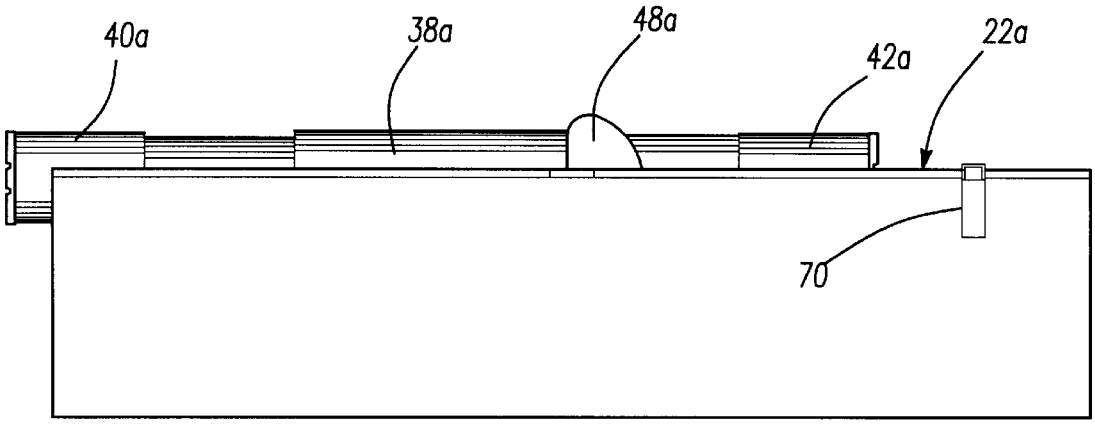
FIG. 29 is a plan view of the portable saw table shown in FIG. 28.

The above described construction permits ready movement of the slide assembly relative to the table base 22*a* to bring the table base and slide assembly into alignment for transportation and storage as shown in FIGS. 28 and 29.

It can thus be seen that there has been provided a portable saw table which is light in weight; which is easily manipulated; which provides for movement of a saw track with respect to the workpiece supporting table; which facilitates both convenient usage and collapsibility for transport and storage; and which can be readily collapsed for transport and storage.

We claim:

1. A portable saw table for use with a portable saw or a rotor comprising:

a supporting plate for the portable saw or rotor, a table base for supporting a workpiece, a support, means mounting said support for pivotable movement to various angles about a pivot axis perpendicular to said table base, an elongated slide having a length dimension and being mounted on said support for longitudinal movement parallel to said length dimension, an elongated track mounted on said slide, said supporting plate being slidably mounted on said track, a protractor mounted on said support and having an arcuate periphery provided with indicia, said protractor being moveable as a unit with said support to the various angles and an indicator mounted on said table base adjacent the periphery of said protractor to indicate the angle of the protractor, and hence the angle of said support on which the protractor is mounted, relative to the table base, said pivot axis and said protractor having a common axis; and wherein said table base and said track are disposed in vertically spaced apart, parallel planes with said track above said table base and wherein said table base has a top side and a bottom side, and said support and said slide are disposed beneath the bottom side of said table base and said track is disposed above the top side of said table base.

2. The portable saw table set forth in claim 1 wherein said slide comprises a member having a non-circular cross section, and means slideably mounting said member on said support.

3. The portable saw table set forth in claim 1 including means for vertically adjusting said track relative to said slide.

4. The portable saw table set forth in claim 1 wherein said slide comprises a pair of spaced longitudinally extending members, and means mounting said pair of members for sliding movement on said support.

5. The portable saw table set forth in claim 4 wherein said pair of members are cylindrical.

6. The portable saw table set forth in claim 1 wherein said slide comprises a member slidable with respect to said support.

7. The portable saw table set forth in claim 6 wherein said member has a cross section comprising an elongated oval cross section.

8. The portable saw table set forth in claim 7 wherein said support includes antifriction means supporting said slide.

9. The portable saw table set forth in claim 1 wherein said slide comprises spaced tubes having ends and a slide member supporting the ends of said tubes at each end thereof.

10. The portable saw table set forth in claim 9 wherein said support comprises an extruded tubular body and end members on said support providing spaced portions having an internal surface slideably receiving said tubes.

11. The portable saw table set forth in claim 10 wherein each said slide member comprises an extruded body.

12. The portable saw table set forth in claim 11 wherein said track comprises end members, said track comprises spaced track members for slidably supporting the supporting plate, each of said end members of said track includes an integral vertical portion, and an integral horizontal portion, said horizontal portion supporting said track members.

13. The portable saw table set forth in claim 12 including a body member adjustably positioned on each said vertical portion, each said body member being fixed on a respective extruded body of said slide member.

14. A portable saw table for use with a portable saw or router comprising a horizontal table base for supporting a workpiece, said table base having opposite sides, a support, means mounting said support beneath said table base for pivotal movement to various angles about a pivot axis perpendicular to said table base, an elongated slide beneath said table base comprising a pair of laterally spaced, parallel, horizontal slide members extending transversely of said table base, said slide members having ends disposed beyond the opposite sides of said table base, means mounting said pair of slide members on said support for longitudinal sliding movement, end members connecting corresponding ends of said slide members, an elongated track comprising a pair of laterally spaced rails above the table base, said rails being parallel to the slide members, vertical posts on opposite sides of the table base mounting said track on said respective end members, a protractor mounted on said support and having an arcuate periphery provided with indicia, said protractor being movable as a unit with said support to the various angles, and an indicator mounted on said table base adjacent the periphery of said protractor to indicate the angle of the protractor, and hence the angle of said support on which the protractor is mounted, relative to the table base, said pivot axis for the support and said protractor having a common axis.

15. The portable saw table set forth in claim 14, and further including means for vertically adjusting said posts to correspondingly vertically adjust said track.

* * * * *